US006710744B2

(12) United States Patent
Morris et al.

(10) Patent No.: US 6,710,744 B2
(45) Date of Patent: Mar. 23, 2004

(54) INTEGRATED CIRCUIT FRACTAL ANTENNA IN A HEARING AID DEVICE

(75) Inventors: Steve Morris, Escondido, CA (US); Steve Pollard, San Diego, CA (US)

(73) Assignee: Zarlink Semiconductor (U.S.) Inc., San Diego, CA (US)

( * ) Notice: Subject to any disclaimer, the term of this patent is extended or adjusted under 35 U.S.C. 154(b) by 0 days.

(21) Appl. No.: 10/090,437

(22) Filed: Feb. 28, 2002

(65) Prior Publication Data

US 2003/0122713 A1 Jul. 3, 2003

Related U.S. Application Data

(60) Provisional application No. 60/346,404, filed on Dec. 28, 2001.

(51) Int. Cl.[7] ..... H01Q 1/38

(52) U.S. Cl. ..... 343/700 MS; 343/792.5

(58) Field of Search ..... 600/25; 607/55, 607/56, 57; 343/700 MS, 850, 846, 702

(56) References Cited

U.S. PATENT DOCUMENTS 5,394,415 A 2/1995 Zucker et al. ..... 372/26
6,127,977 A 10/2000 Cohen ..... 343/700 MS
6,140,975 A 10/2000 Cohen ..... 343/846
6,380,896 B1 * 4/2002 Berger et al. ..... 343/700 MS
6,390,971 B1 * 5/2002 Adams et al. ..... 600/25
6,452,553 B1 * 9/2002 Cohen ..... 343/702
6,476,766 B1 * 11/2002 Cohen ..... 343/700 MS

FOREIGN PATENT DOCUMENTS

WO Wo 01/54221 A1 7/2001

OTHER PUBLICATIONS

Walker et al., "Fractal Volume Antennas", (1998) Electronic Letters vol 34 No. 16 pp. 1536–1537.

Vinoy et al., "Hilbert Curve Fractal Antenna: A Small Resonant Antenna For VHF/UHF Applications", (2001) Microwave and Optical Technology Letters vol. 29 No. 4 pp. 215–219.

Cohen N., "Fractal Antenna Applications in Wireless Telecommunications", (1997) IEEE pp. 43–49.

Werner, et al., A Design approach for Dual Polarized Multiband Frequency Selective Surfaces Using Fractal Elements, *IEEE*, Aug. 2000, pp. 1692–1695.

* cited by examiner

*Primary Examiner*—James Clinger
(74) *Attorney, Agent, or Firm*—Knobbe, Martens, Olson & Bear, LLP

(57) ABSTRACT

A fractal antenna can be incorporated in a hearing device to optimize wireless communication capabilities of such a device. A particular fractal structure having fractals of a generally + shaped geometry can be advantageous when used as a fractal antenna. The fractal antenna is implemented as a conductive trace on a substrate and can be implemented on an integrated circuit in the hearing aid device.

16 Claims, 9 Drawing Sheets

60

220

INTEGRATED CIRCUIT FRACTAL ANTENNA IN A HEARING AID DEVICE

CROSS REFERENCE TO RELATED APPLICATION

This application claims priority to U.S. Provisional Patent Application No. 60/346,404 entitled "INTEGRATED CIRCUIT FRACTAL ANTENNA IN A HEARING AID DEVICE" and filed on Dec. 28, 2001. The disclosure of the above-described filed application is hereby incorporated by reference in its entirety.

BACKGROUND OF THE INVENTION

1. Field of the Invention

The invention relates to fractal antennas, and more particularly a fractal antenna in an integrated circuit.

2. Description of the Related Art

Programmable hearing aids allow precise adjustment of the specific parameters of hearing aid operation so as to achieve reasonably good operation personalized for the user.

Hearing aids have traditionally been programmed with a multi-wire interface, including a physical connection to a device worn on the body that incorporates a wired link to the hearing aid programmer, e.g. a multi-wire interface directly between the programmer and the hearing aid. The use of a wire interface requires the hearing aid to incorporate a connector, or multiple connectors, into its structure for the programming cable, which can be cumbersome and complicated for the user.

Typical programming interfaces use serial data transmission employing two to four electrical connections located on the hearing aid device. Alternately, newer connection schemes use the battery terminals on the hearing aid device to supply power and transmit data to the hearing aid. This approach, however, sometimes requires additional battery contacts depending on the nature of the serial data interface. These data transmission methods require special programming cables and small sized connectors that are fragile and costly to manufacture. In addition, due to the physically small size of hearing aids, reliable wire connections to the hearing aid device from the programming device can be difficult to achieve.

Wireless programming methods, such as infrared and ultrasonic links, have been used in the past in place of a multi-wire programming interface, but generally require relatively complex circuitry and introduce additional limitations to the device and programming capabilities. Infrared and ultrasonic links generally experience high rates of power consumption and are susceptible to interference and undesirable directional characteristics.

Therefore, an improved wireless programming interface would greatly increase the ease and reliability of programming a hearing aid.

SUMMARY OF THE INVENTION

A programmable hearing aid, configured to transmit and/or receive a signal to and/or from a programming device, comprises a semiconductor substrate, a conductive pattern, disposed on the semiconductor substrate so as to transmit and/or receive a signal to and/or from the programming device, wherein the conductive pattern comprises a plurality of fractal elements of different scales and orientations. The programmable hearing aid further comprises transmit and/or receive circuitry, disposed on the semiconductor substrate, coupled to the conductive pattern and configured to receive and process a signal from the conductive pattern, and/or process a signal to be transmitted to the conductive pattern. The plurality of fractal elements can be of a generally + shaped geometry.

A method of programming a plurality of parameters in a wireless hearing aid comprises receiving a programming signal at a fractal antenna in the hearing aid, wherein the fractal antenna comprises a conductive pattern disposed on a substrate, and wherein the conductive pattern comprises a plurality of fractal elements, repeated in multiple scales and orientations. The method further comprises processing the programming signal in a receiver circuit in the hearing aid, thereby producing a processed programming signal, the receiver circuit coupled to said fractal antenna, and modifying at least one parameter in the hearing aid with at least one of the parameters from the processed programming signal.

A fractal antenna comprises a plurality of fractal elements, wherein each fractal element comprises a generally +-shaped geometry, and the plurality of fractal elements are repeated in a plurality of scales and orientations. The fractal antenna can be disposed on a semiconductor substrate as a conductive pattern, and can be incorporated in a hearing aid device.

An integrated circuit comprises a semiconductor substrate, a conductive pattern, defining a plurality of fractal elements of a generally + shaped geometry of different dimensions, disposed on said semiconductor substrate. The integrated circuit may further comprise a receiver circuit, coupled to the conductive pattern and configured to receive a signal from the conductive pattern. The integrated circuit may also further comprise a transmit circuit, coupled to the conductive pattern and configured to transmit a signal to the conductive pattern.

DETAILED DESCRIPTION OF THE PREFERRED EMBODIMENT

Embodiments of the invention will now be described with reference to the accompanying Figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Wireless data transmissions typically include the use of signal transmission antennas, which can vary in size and shape depending on the application. An arbitrary reduction in the size of a conventional antenna can result in a large reactance and degradation in the performance of the antenna. A small sized loop antenna, or short dipole, requires significant space due to its performance dependence upon the physical area of the antenna. Therefore, due to the small size of hearing aids, the use of conventional signal transmission antennas does not readily apply.

Recently, research in fractal antennas has proved their behavior to be concurrent with their physically larger counterparts, while maintaining a size five to ten times smaller than an equivalent conventional antenna. Nathan Cohen developed a number of fractal antennas and reported his findings on their capabilities in 1994, and continues to focus on antennas optimized for a frequency of 900 MHz for an antenna size as small as an eighth of a wavelength. A research group in Spain has persisted in development and documentation of fractal antennas, and several academic research groups continue to study the operation and applications of fractal antennas.

For incorporation into small electronic devices, such as hearing aids, a conductive pattern can be deposited on a substrate to form a plurality of fractal elements, resulting in a resonator, or fractal antenna. The plurality of fractal elements can be of different dimensional sizes and in a number of spatial orientations.

Figure 1:
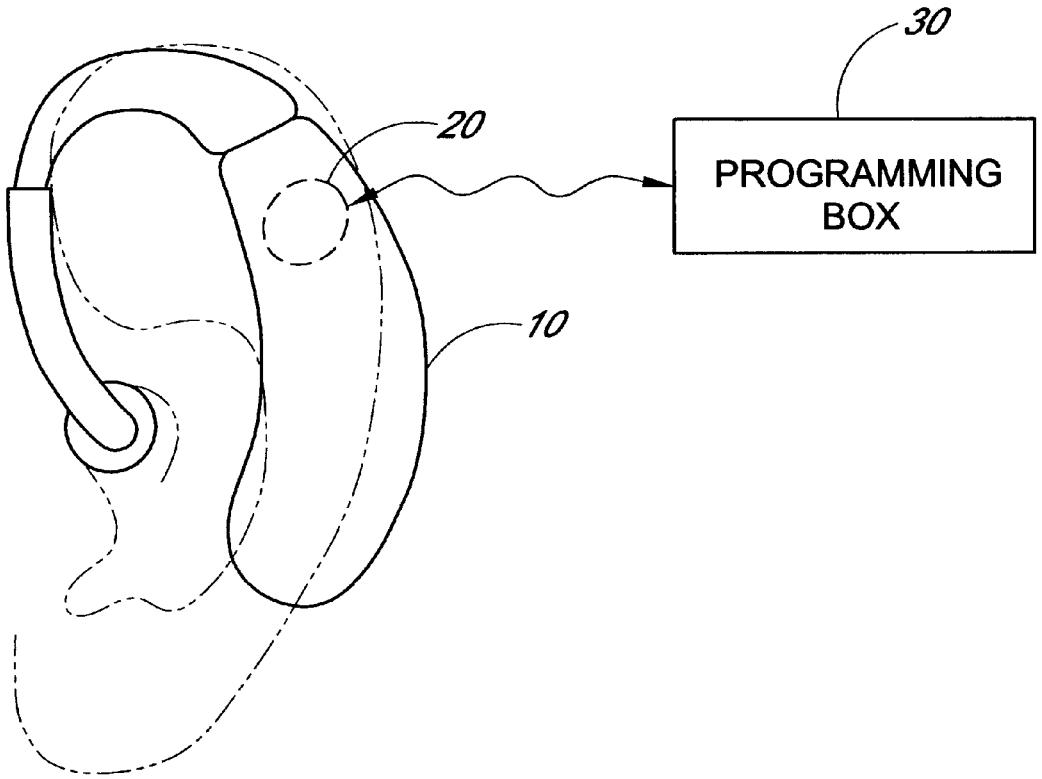
FIG. 1 is an exemplary illustration of a hearing aid device.

As shown in FIG. 1, a fractal antenna 20 can be incorporated in a hearing aid 10 to facilitate communications with a programming box 30. It will be appreciated that the antenna 20 can be used to transmit and/or receive signals from devices other than the programming box 30, such as a wireless telephone. The programming box 30 can communicate hearing aid parameters to the hearing aid device 10, and can receive information from the hearing aid device 10. The fractal antenna 20 can be implemented as a conductive pattern, disposed on a substrate, comprising a number of fractal elements repeated in multiple orientations and scales. The fractal antenna 20 can be configured to receive and/or transmit signals to and/or from the programming box 30. The hearing aid 10 can appropriately have receive and/or transmit circuitry (not shown), so as to process a received signal, or process a signal for transmission.

Fractals have been used to model many environmental phenomenon, such as trees and lightning, and common references in the art are authored by Hans Lauwerier, and Benoit Mandlebrot. Fractals consist of similar or identical elements repeated in different orientations, positions, and degrees of magnification, typically in an interconnected order. Most fractals have an infinite complexity and detail, thus the complexity and detail of the fractals remain no matter how far an observer magnifies the fractal object. The combination of infinite complexity and detail, in addition to the self-similarity inherent to fractal geometry, makes it possible to construct very small sized antennas with fractal structures, which can operate at high efficiency at multiple frequencies. Although a fractal is infinite by definition, a practical fractal is referred to herein where the multitude and level of scales at which the fractal is repeated can change as implementation technology permits.

As used herein, a fractal antenna is a pattern of conductive or semi-conductive material in two or three dimensions having at least one geometric feature that is repeated on different scales, different positions, and/or in different orientations. In one embodiment, described in additional detail below, the repeated feature is a "+", "x", or cross.

A fractal antenna structure can produce a directive radiation pattern at a given frequency, and can therefore be useful in a wireless hearing aid communication system due to the structure's size reduction capabilities. The fractal antenna 20 is appropriate for a low energy, low power system such as the hearing aid 10 due to both size constraints of the device and the prospect of matching the load impedance by selecting a frequency in a range such as about 1 MHz to 1 GHz.

Very few fractal patterns, such as Hilbert curves and the Sierpenski gasket, have been implemented as fractal antenna structures. The use of fractals in an antenna geometry, in addition to being simple and self-similar, can allow a plane to be filled with different size iterations of similar geometry, and such properties can be exploited to form a reduced size resonant antenna.

Figure 2:
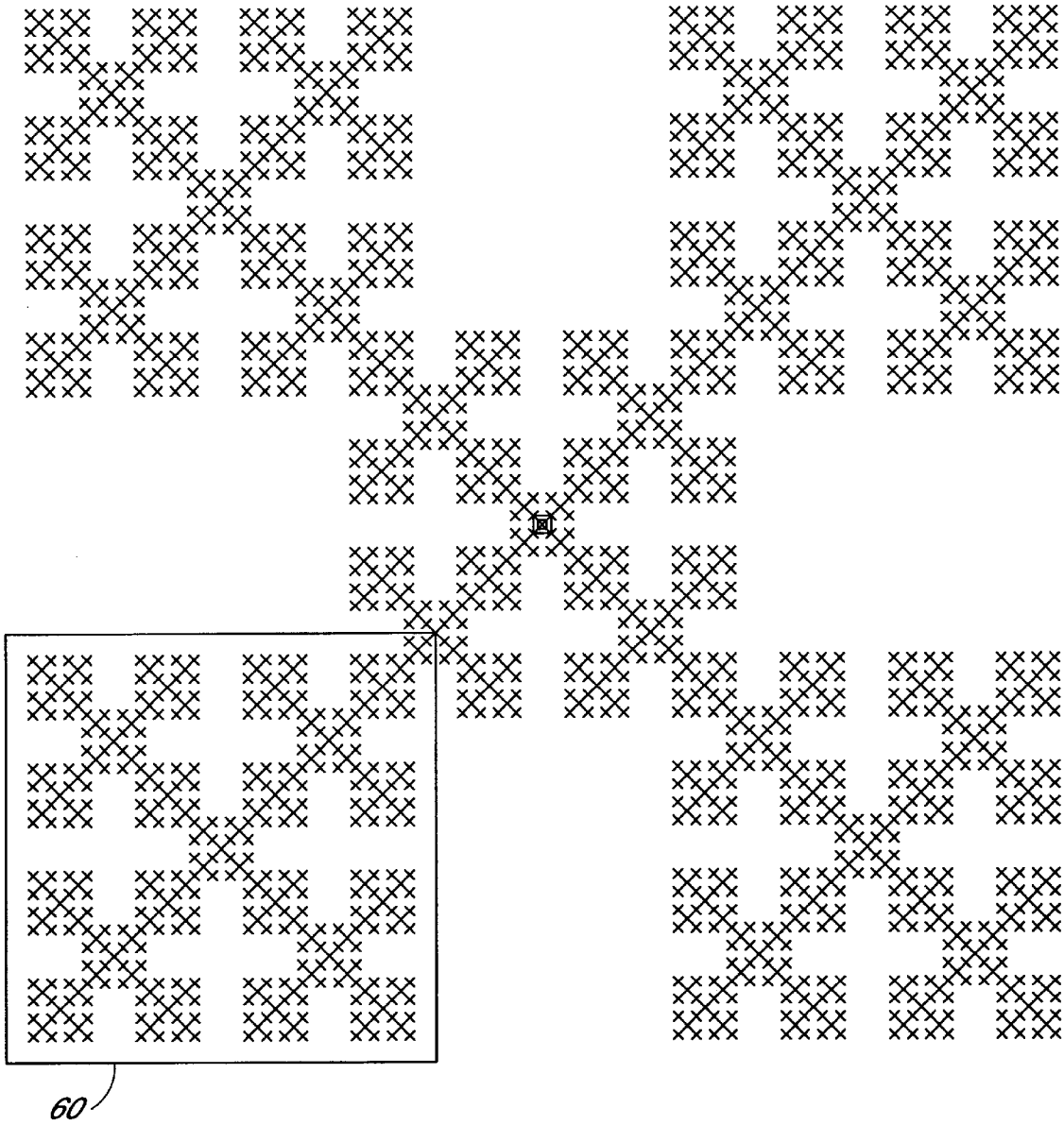
FIG. 2 is an illustration of a fractal antenna structure, referred to herein as a Pollard antenna structure.
Figure 3:
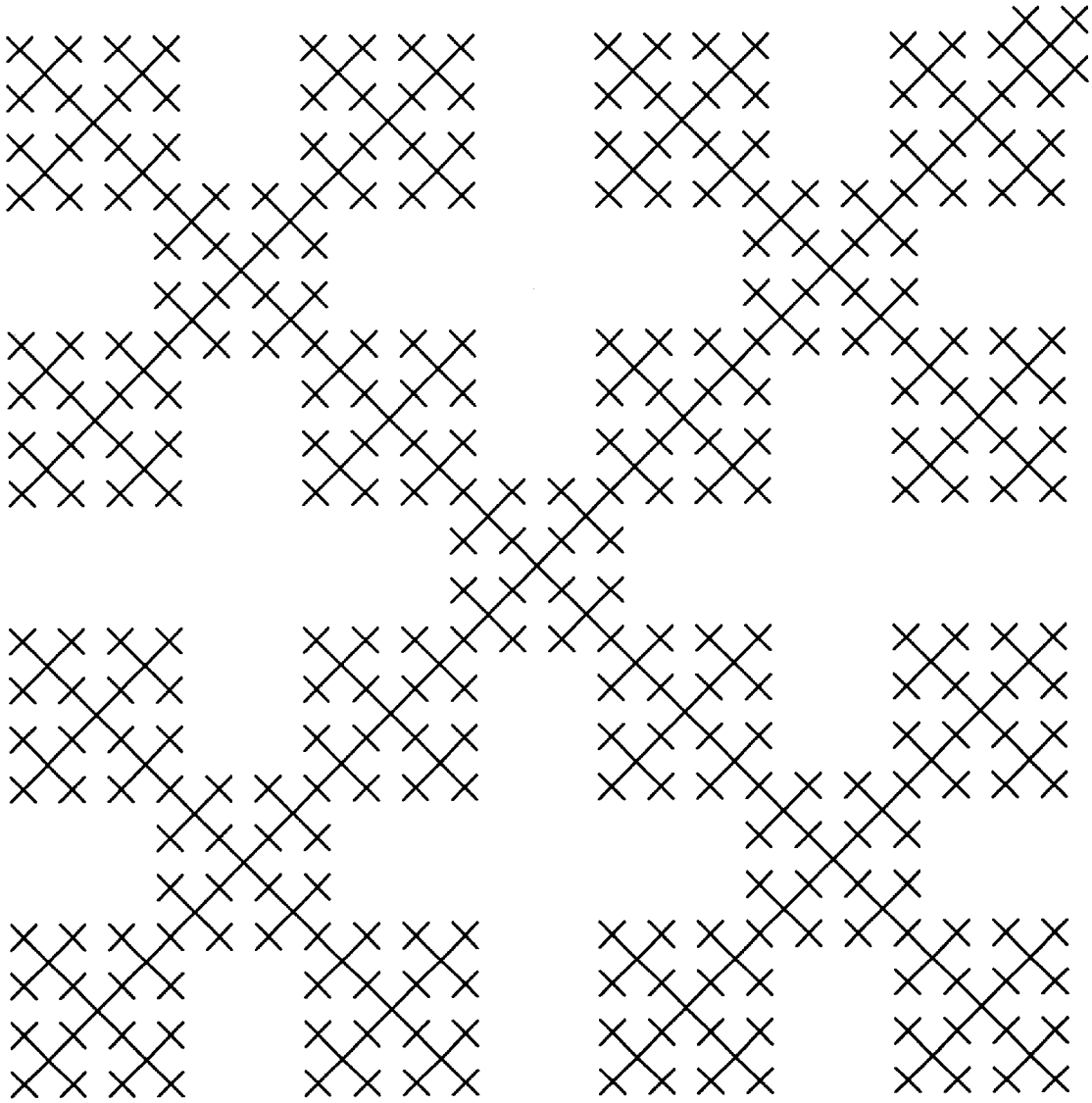
FIG. 3 is a magnified illustration of the Pollard antenna of FIG. 1.

FIG. 2 illustrates a fractal antenna structure, referred to herein as a Pollard structure. The Pollard antenna structure consists of a fractal geometry similar to an X-shape, or cross, repeated in multiple orientations and scales to form, in one embodiment, a structure such as that illustrated in FIG. 2. As can be seen, looking at a specific area of the antenna in FIG. 2, such as area 60, as the level of magnification is increased, the X-shape, + shape, or cross geometry is maintained, but on a smaller scale, as shown in FIG. 3.

Figure 4:
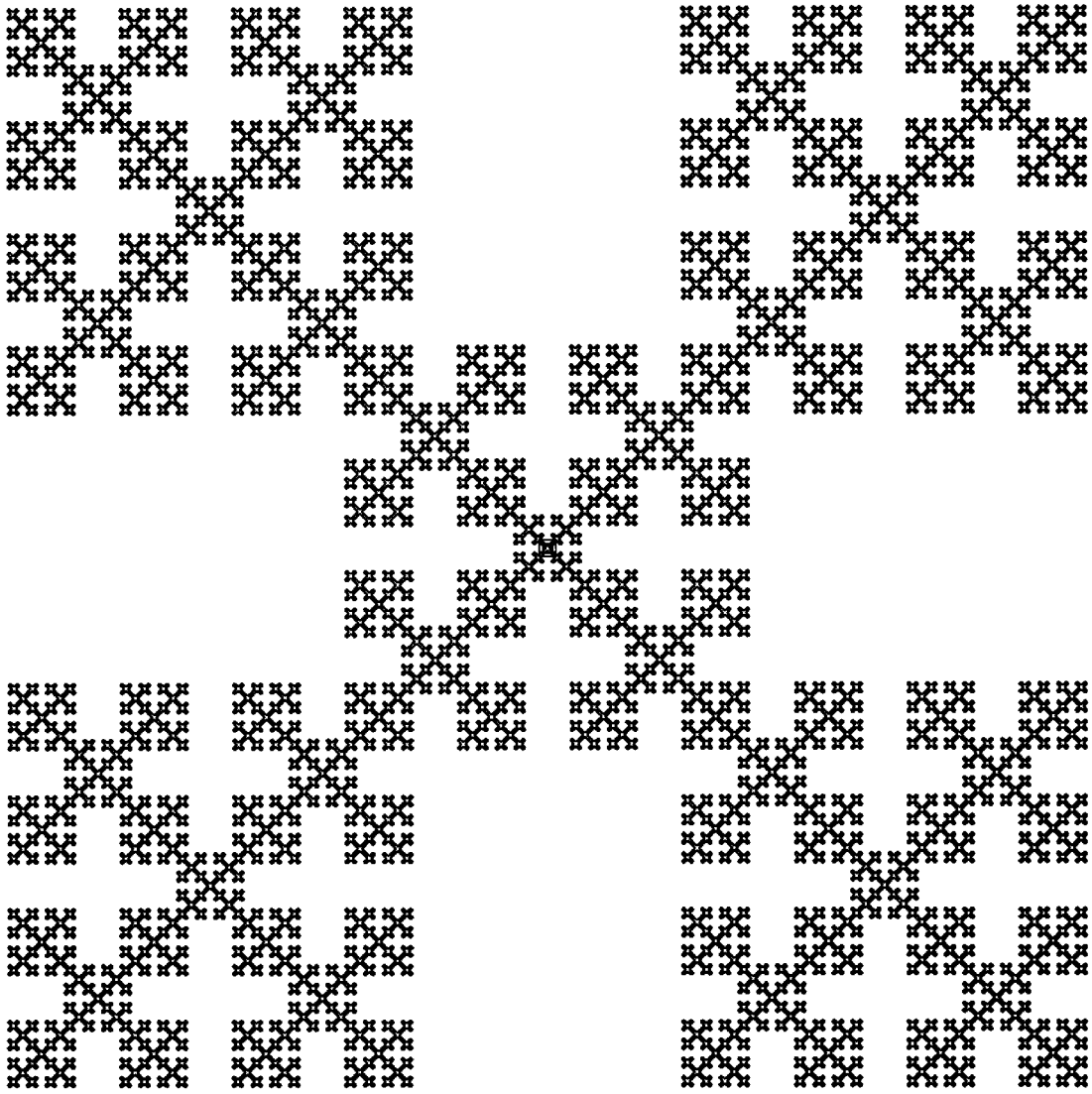
FIG. 4 is an illustration of an alternative Pollard antenna structure.

Fractal antennas can be extensively reduced in size while maintaining resonant characteristics which correspond to much larger antennas, including deposition on something as small as an integrated circuit substrate. The fractal Antenna of FIG. 2 can be formed by depositing connected substantially linear segments of conductive material on a substrate in the pattern illustrated in FIG. 2. An alternate fractal antenna can be formed by depositing linear segments of conductive material on a substrate in a pattern defined by the opposed edges of the linear segments shown in FIG. 2. This embodiment is illustrated in FIG. 4. The antenna pattern of FIG. 4 can be formed by depositing thick linear segments in the solid pattern of FIG. 2, and then etching away the central portion of the thick linear segments, thereby leaving behind an outline of conductive material defined by the perimeter of the linear pattern shown in FIG. 2. The Pollard antenna design can be reduced from about 1.4 mm on a side, down to about 0.4 mm on a side for incorporation in small electronic devices, such as the hearing aid illustrated in FIG. 1.

The incorporation of a fractal antenna in the hearing aid device 10 can allow the device to communicate, or be programmed by a remote device without incorporating additional connectors onto the device. Such receive and transmit capabilities can allow the device to be programmed without wired connections, or to receive specialized signals in environments modified for hearing aid device users.

Many performance and concert venues have recently been constructed or updated to assist hearing aid users in such environments, and cellular phones can be adapted to function in combination with a hearing aid device. It would be beneficial for hearing aid users to have the capability to utilize such enhancements and adaptations without having to adjust settings on their individual devices, or without having to use an additional external device and connection in such an environment. Such capabilities can be realized by the incorporation of the fractal antenna 20 in the hearing aid 10 of FIG. 1. The hearing aid 10 can receive signals from the modified environment or communication device at the fractal antenna 20, without having to use an additional aiding device or wire connection.

Since antennas typically operate with reciprocity, a transmitter can also be used as a receiver to assist in determining antenna characteristics. The majority of the following description of a fractal antenna and corresponding circuitry will pertain to transmission capabilities of the device, however, it will be appreciated that such design approaches are applicable to receive capabilities and the device may be optimized for either or both functions.

Figure 5:
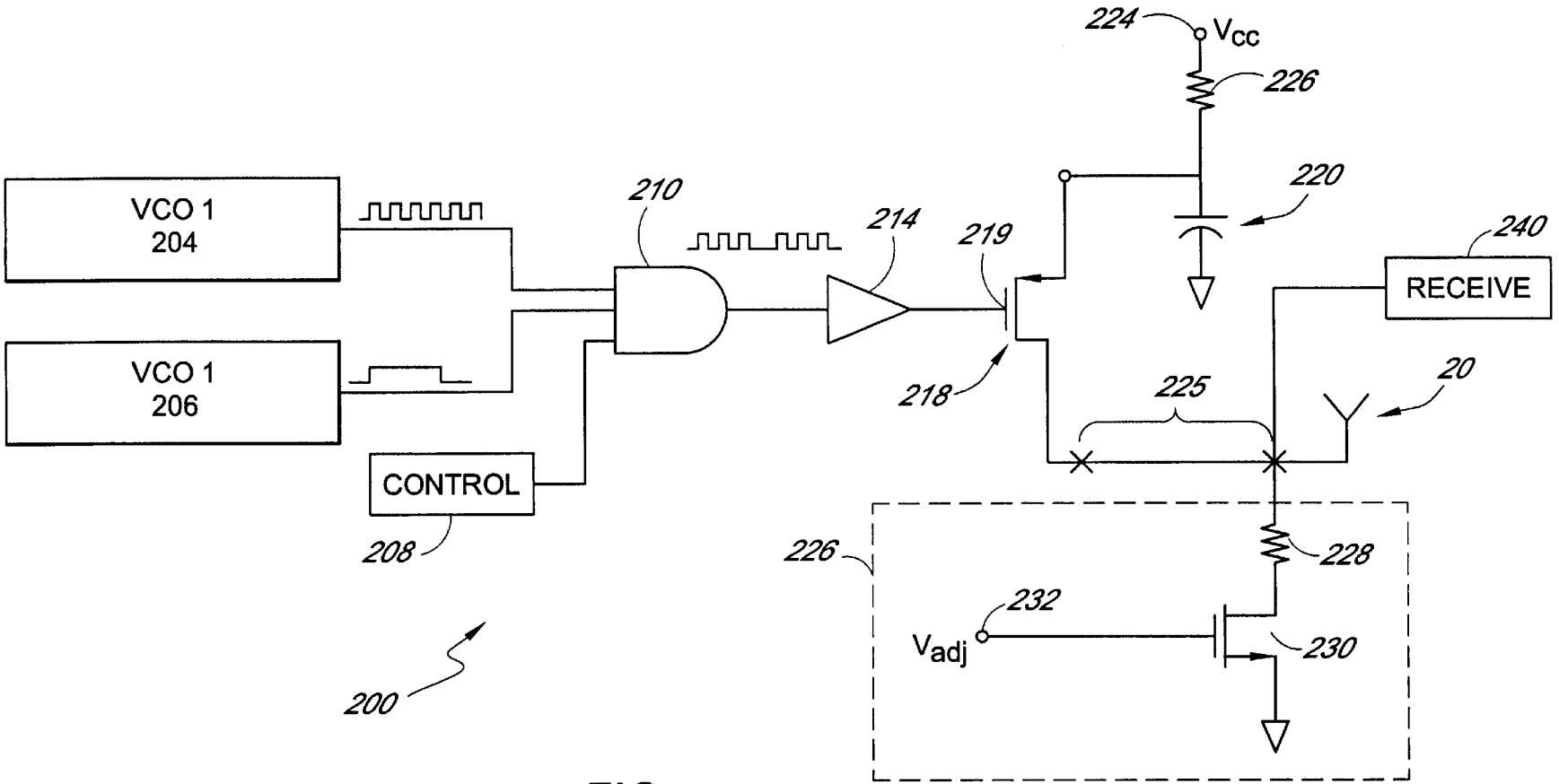
FIG. 5 is an exemplary schematic diagram of a signal transmission circuit.

Although antenna drive circuitry for a fractal antenna can be developed by those skilled in the art, an exemplary drive circuit is described herein. FIG. 5 is a schematic diagram of an exemplary signal transmission circuit 200 for use with a fractal antenna, such as the Pollard antennas illustrated in FIGS. 2–4. The circuit can be implemented in the hearing aid 10 of FIG. 1, including the fractal antenna 20. The circuit 200 comprises a first voltage controlled oscillator (VCO1) 204 and second voltage controlled oscillator (VCO2) 206, wherein the oscillation frequencies of such signal sources 204, 206 can be set by applying a DC voltage. The voltage controlled oscillators 204, 206 can operate at a 50% duty cycle at frequencies of about 1 KHz to about 1 GHz. A logic gate 210, in this case an AND gate, receives output signals from the pulse train source 204, the envelope source 206, and a control input 208. Thereby, the AND gate 210 transmits one or a series of pulse trains from the first voltage controlled oscillator 204 when the control input 208 is triggered.

A signal from the output of the logic gate 210 is received at a buffer 214, or network of buffers, etc. More particularly, the buffer 214 can be implemented as a ladder structure, wherein each parallel rung is a buffer in series with a resistive element. The output of the buffer 210 is connected to a switch, which is implemented in this embodiment as a PMOS transistor 218, wherein the output of the buffer 210 is connected to a gate terminal 219 of the PMOS transistor 218. The source terminal of the PMOS transistor 218 is coupled to a capacitor 220, which receives a charging voltage from a source $V_{cc}$ 224 through a resistor 226. A first end of a transmission line 225 can be connected to the drain terminal of the transistor 218, and a second end of the transmission line 225 can be connected directly to the fractal antenna 20. As the PMOS transistor 218 is turned off by a signal from the logic gate 210, via the buffer 214, the capacitor 220 is allowed to charge from the voltage source $V_{cc}$ 224. When the control input 208 is triggered, the enveloped pulse train is transmitted via the logic gate 210 and buffer 214 to the PMOS transistor 218, and the capacitor discharges through the transistor 218 to the transmission line 225.

A transmission line termination 226 can be connected between the transmission line 225 and the antenna 20, such that the signal transmission circuit 200 can be de-coupled from the antenna 20, and the termination impedance of the transmission line can be controlled. In this embodiment, the termination 226 comprises a resistor 228 in series with an NMOS transistor 230, wherein the gate terminal of the NMOS transistor 230 receives a voltage signal $V_{adj}$ 232 so as to adjust the termination impedance of the transmission line 225. A receiver circuit 240 can also be connected to the antenna 20, and the termination 226 can decouple the receive circuitry from the antenna 20.

Figure 6:
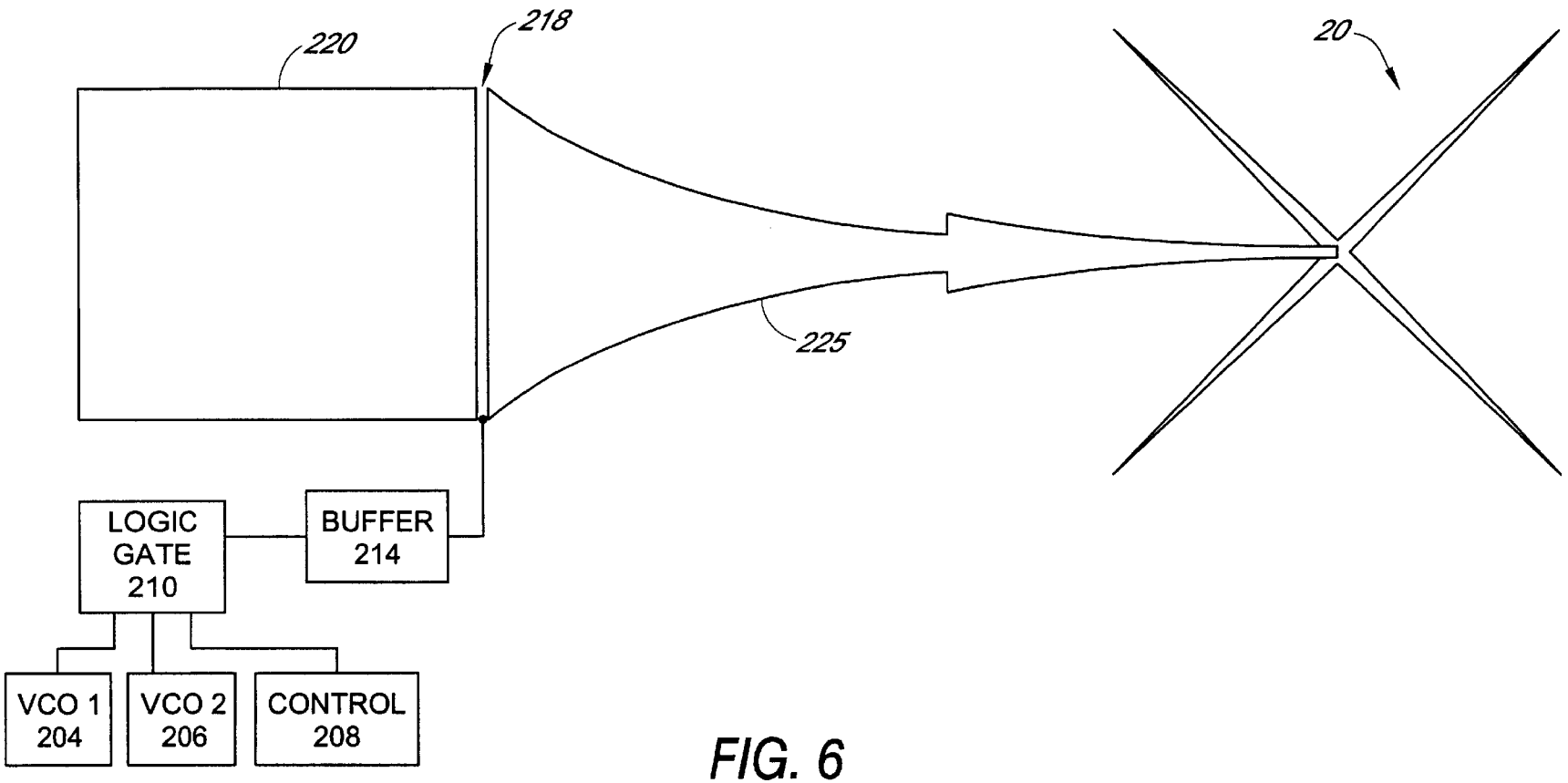
FIG. 6 is an exemplary illustration of a signal transmission circuit disposed on a substrate for a fractal antenna.

FIG. 6 illustrates a top view of one embodiment of the transmission circuit 200 implemented on a substrate, and a corresponding substrate stack diagram. The first and second voltage controlled oscillators 204, 206, control input 208, and buffer 214 are shown simply as blocks in FIG. 6, while the voltage sources 224, 230 are not illustrated.

In FIG. 6, the capacitor 220 is implemented as a slotted capacitor, which can be formed on a substrate by a plurality of metal layers to optimize the capacitance. This layered structure can be seen more clearly in FIG. 7. However, it will be appreciated that a capacitative charge portion can be formed or implemented in alternative embodiments known to those of skill in the art. Only one layer of the capacitor 220 is illustrated in FIG. 6. In the present embodiment, the transmission line 225 is formed of multiple, tapered or curved portions of a conductor plane, wherein the width of the transmission line 225 can be designed to decrease exponentially so as to increase the impedance as a signal travels along the transmission line 225.

Referring to FIG. 6, the capacitor 220 is charged with current from the voltage source 224 (not shown), and when the logic gate 210 is enabled, the gate of the PMOS transistor 218, located between the capacitor 220 and the transmission line 225, is active and the transistor 218 transmits across the gap between the capacitor 220 and the transmission line 225. When the PMOS switch 218 is closed, the pulse, or pulses from the first voltage controlled oscillator travel from the capacitor 220 down the transmission line 225. As the pulse travels down the transmission line 225 toward the antenna 20, the transmission line 225 acts as an impedance transformer due to its size and shape, such that the pulse is fed to the antenna 20 from a matched impedance point on the transmission line 225.

The switch 218 can be implemented with a PMOS transistor as shown, or light activated switches may be used to increase switching speed, such as those described in U.S. Pat. No. 5,394,415 to Zucker et al. The use of the pulsed signal source can provide higher peak transmission than a continuous wave source, and can produce, for example, a peak transmission power of over a Watt.

Figure 7:
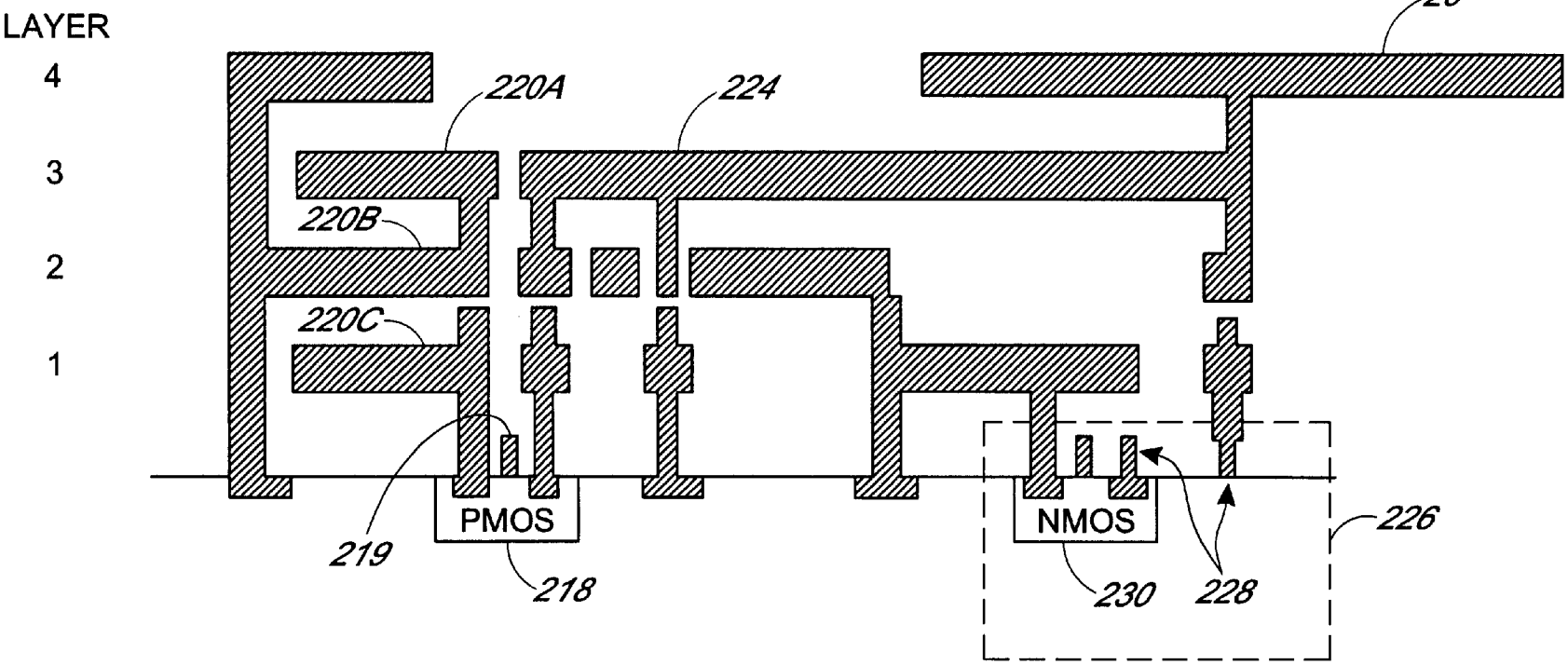
FIG. 7 is a substrate layer diagram, corresponding to the signal transmission circuit illustrated in FIG. 6.

FIG. 7 is a substrate layer diagram corresponding to the signal transmission circuit illustrated in FIG. 6. The capacitor 220 can be seen as comprising three deposited metal layers 220A–C, and the source terminal of the PMOS transistor 218 is connected to the capacitor 220. The gap between the capacitor 220 and the transmission line 225 is illustrated, wherein the gate terminal 219 of the PMOS transistor is located in the gap between the capacitor 220 and the transmission line 225. A level is illustrated where a conductive pattern, forming the fractal antenna 20, can be located, and the transmission line can be fed directly to an approximate center of the antenna 20. At the connection point between the transmission line 225 and the antenna 20, the termination 226 can be seen comprising the termination resistor 228 and NMOS transistor 230.

Figure 8:
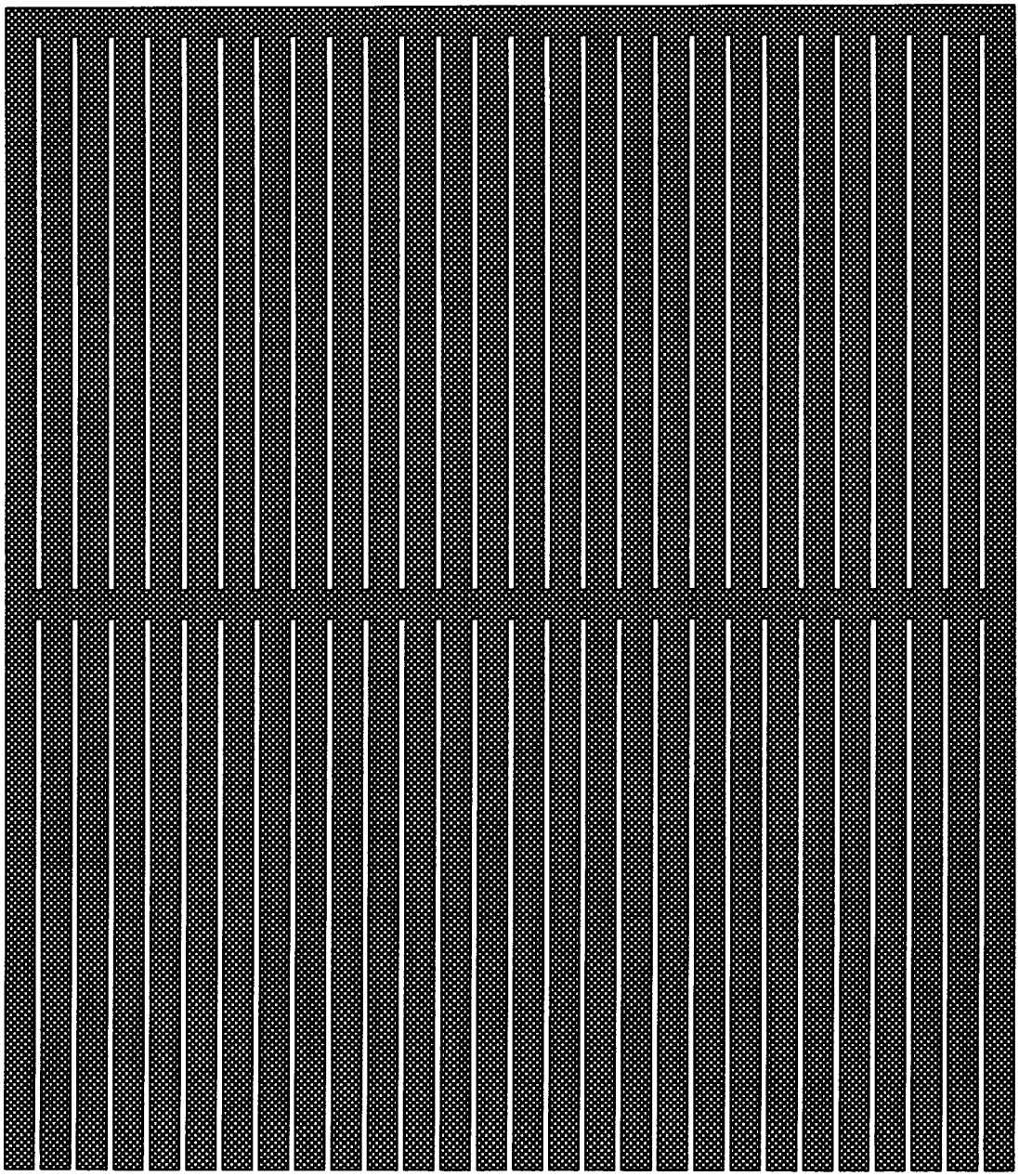
FIG. 8 is more detailed illustration of one embodiment of a capacitor for incorporation in the signal transmission circuit of FIG. 6.

FIG. 8 is a more detailed illustration of one embodiment of the capacitor layer 220A–C having slots void of conducting material. The slot shaped voids can optimize fabrication of the capacitor 220 wherein a solid plane of conducting material may not function as well.

Figure 9:
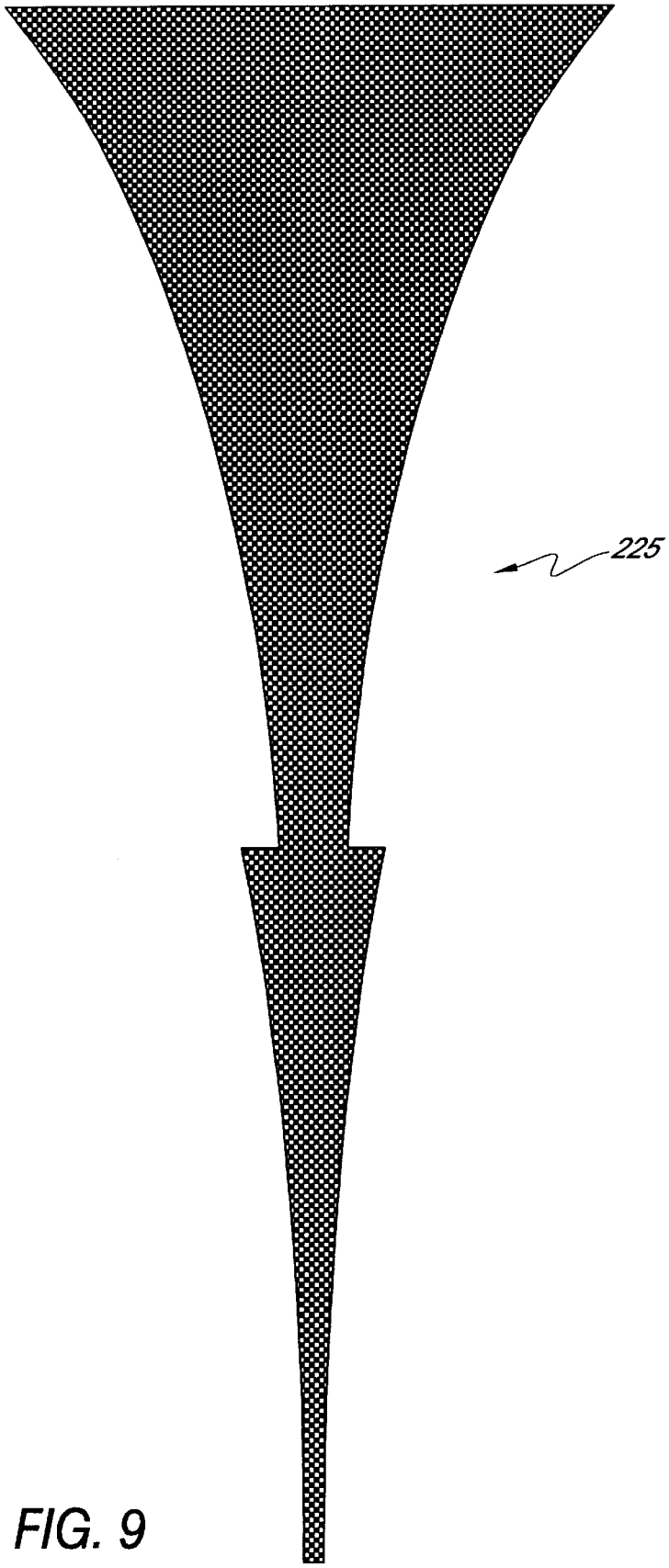
FIG. 9 is a more detailed illustration of one embodiment of a signal transmission line for incorporation in the signal transmission circuit of FIG. 6.

FIG. 9 is a more detailed illustration of one embodiment of the transmission line 225. In one advantageous embodiment, the width of the transmission line 225 decreases exponentially, however, ellipses of particular dimension can be used to fit the exponentially curved portions of the transmission line 225. An ellipse curve may be more readily available and easier to use than an exponential curve for a printed circuit board layout and production process. Additionally, holes, or voids of conducting material can be punched or etched in the transmission line 225 conduction plane so as to optimize fabrication of the transmission line 225, these holes are illustrated in FIG. 9.

The transmission line can feed the pulse signal to the antenna structure using proximity feed or direct connect feed. In one embodiment, a direct connect feed is used to connect the transmission line 225 directly to the antenna 20. Proximity feed can be used in combination with an aperture to terminate the transmission line, and for proximity feed it is possible to stack multiple antenna elements so as to increase the bandwidth of the antenna capabilities.

The transmission line termination 226 can also be controlled so as to de-couple the rest of the signal transmission circuitry from the antenna 20 to optimize reception capabilities of the antenna 20. The inclusion of the fractal antenna 20, using the Pollard antenna designs illustrated in FIGS. 2–3, for example, can improve a hearing aid device's capabilities for customized programming and enhance performance due to more effective compatibility with newly modified, hearing aid friendly environments.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A fractal antenna, comprising:

a plurality of connected conductive material portions forming an array of a plurality of fractal elements, wherein each fractal element comprises two linear elements intersecting at substantially right angles substantially at their midpoints, and said plurality of fractal elements are repeated in a plurality of scales and orientations.

2. An integrated circuit, comprising:

a semiconductor substrate; and a conductive pattern, defining a plurality of fractal elements of different dimensions, disposed on said semiconductor substrate, wherein each of said fractal elements comprises two linear elements intersecting at substantially right angles substantially at their midpoints.

3. The integrated circuit of claim 2, further comprising a receiver circuit, coupled to said conductive pattern and configured to receive a signal from said conductive pattern.

4. The integrated circuit of claim 2, further comprising a transmit circuit, coupled to said conductive pattern and configured to transmit a signal to said conductive pattern.

5. A programmable hearing aid, configured to transmit and/or receive a signal to and/or from a programming device, comprising:

a semiconductor substrate;

a conductive pattern, disposed on said semiconductor substrate so as to transmit and/or receive a signal to and/or from said programming device, wherein said conductive pattern comprises a plurality of fractal elements of different scales and orientations, and wherein each fractal element comprises two linear elements intersecting at substantially right angles substantially at their midpoints; and transmit and/or receive circuitry, disposed on said semiconductor substrate, coupled to said conductive pattern and configured to receive and process a signal from said conductive pattern, and/or process a signal to be transmitted to said conductive pattern.

6. A method of programming a plurality of parameters in a wireless hearing aid, comprising:

receiving a programming signal at a fractal antenna in said hearing aid, wherein said fractal antenna comprises a conductive pattern disposed on a substrate, and wherein said conductive pattern comprises a plurality of fractal elements, repeated in multiple scales and orientations, and wherein each fractal element comprises two linear elements intersecting at substantially right angles substantially at their midpoints;

processing said programming signal in a receiver circuit in said hearing aid, thereby producing a processed programming signal, said receiver circuit coupled to said fractal antenna; and modifying at least one parameter in said hearing aid with at least one of said parameters from said processed programming signal.

7. The method of claim 6, further comprising transmitting a signal from said wireless hearing aid through said fractal antenna.

8. A hearing aid comprising a semiconductor substrate having a conductive pattern deposited thereon, wherein said conductive pattern comprises a plurality of fractal elements, repeated in multiple scales and orientations, and wherein each fractal element comprises two linear elements intersecting at substantially right angles substantially at their midpoints.

9. A hearing aid, comprising:

a transmission line deposited on a semiconductor substrate; and a conductive pattern deposited on said semiconductor substrate, wherein said conductive pattern is coupled to said transmission line, wherein said conductive pattern comprises a plurality of fractal elements, repeated in multiple scales and orientations, wherein each fractal element comprises two linear elements intersecting at substantially right angles substantially at their midpoints, and wherein a signal is transmitted by said conductive pattern in pulses.

10. The hearing aid of claim 9, wherein said pulses are formed by a pulse forming network, coupled to said transmission line.

11. The hearing aid of claim 10, wherein said pulse forming network comprises a capacitor and a transistor.

12. The hearing aid device of claim 9, wherein each fractal element comprises two linear elements intersecting at substantially right angles.

13. A hearing aid, comprising:

a transmission line deposited on a semiconductor substrate, wherein said transmission line has a plurality of holes, void of conducting material; and a conductive pattern deposited on said semiconductor substrate, wherein said conductive pattern is coupled to said transmission line, wherein said conductive pattern comprises a plurality of fractal elements, repeated in multiple scales and orientations.

14. A hearing aid, comprising:

a transmission line deposited on a semiconductor substrate, wherein said transmission line has multiple, tapered portions, and wherein said tapered portions are formed using a fraction of an outline of an ellipse; and a conductive pattern deposited on said semiconductor substrate, wherein said conductive pattern is coupled to said transmission line, and wherein said conductive pattern comprises a plurality of fractal elements, repeated in multiple scales and orientations.

15. A hearing aid, comprising:

a transmission line deposited on a semiconductor substrate;

a conductive pattern deposited on said semiconductor substrate, wherein said conductive pattern is coupled to said transmission line, wherein said conductive pattern comprises a plurality of fractal elements, repeated in multiple scales and orientations, and wherein a signal is transmitted by said conductive pattern in pulses; and a pulse forming network, coupled to said transmission line and comprising a capacitor and a transistor, wherein said pulses are formed by said pulse forming network, wherein said capacitor is formed on said semiconductor substrate, and wherein said capacitor comprises a plurality of slots void of conducting material.

16. A method of wirelessly communicating with a hearing aid, comprising sending an electromagnetic transmission signal to a fractal antenna in said hearing aid, wherein said fractal antenna comprises a conductive pattern disposed on a substrate, and wherein said conductive pattern comprises a plurality of fractal elements, repeated in multiple scales and orientations, and wherein each of said fractal elements comprises two linear elements intersecting at substantially right angles substantially at their midpoints.

* * * * *

UNITED STATES PATENT AND TRADEMARK OFFICE

CERTIFICATE OF CORRECTION

PATENT NO. : 6,710,744 B2
DATED : March 23, 2004
INVENTOR(S) : Morris et al.

It is certified that error appears in the above-identified patent and that said Letters Patent is hereby corrected as shown below:

Column 8,
Line 55, please delete "Claim 12."

Signed and Sealed this

Twelfth Day of April, 2005

JON W. DUDAS
*Director of the United States Patent and Trademark Office*